US006889585B1

(12) United States Patent
Harris et al.

(10) Patent No.: US 6,889,585 B1
(45) Date of Patent: May 10, 2005

(54) CUTTER BLADE POSITION DETECTION MECHANISM AND METHOD OF REPORTING CUTTER MALFUNCTION

(75) Inventors: Richard Hunter Harris, Raleigh, NC (US); Jeff David Thomas, Raleigh, NC (US); Robert Dean Yoder, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/478,246

(22) Filed: Jan. 4, 2000

(51) Int. Cl.[7] ..... B26D 5/00

(52) U.S. Cl. ..... 83/62; 83/72; 83/76.7; 83/76.9; 83/522.12; 83/942

(58) Field of Search ..... 83/927, 72, 74, 83/76, 522.25, 522.27, 522.12, 522.23, 62.1, 62, 76.9, 76.7, 76.6, 76.8, 367, 942

(56) References Cited

U.S. PATENT DOCUMENTS

| | | | | | |
|---|---|---|---|---|---|
| 2,792,883 | A | * | 5/1957 | Pokorski | 83/524 |
| 3,339,434 | A | * | 9/1967 | Sparling | 83/62 |
| 3,614,306 | A | * | 10/1971 | Goldberg et al. | 358/304 |
| 3,621,395 | A | * | 11/1971 | Brown et al. | 408/16 |
| 3,744,362 | A | * | 7/1973 | Gesell et al. | 83/522.12 |
| 3,747,142 | A | * | 7/1973 | Arbogast et al. | 83/62 |
| 3,769,666 | A | * | 11/1973 | Kaufman | 241/37 |
| 3,817,134 | A | * | 6/1974 | Katayama et al. | 399/385 |
| 3,982,454 | A | * | 9/1976 | Schneider et al. | 83/74 |
| 3,990,805 | A | * | 11/1976 | Ducrohet | 408/11 |
| 4,056,024 | A | | 11/1977 | Baert et al. | |
| 4,091,698 | A | * | 5/1978 | Obear et al. | 83/34 |
| 4,104,795 | A | | 8/1978 | Lopic | |
| 4,205,567 | A | * | 6/1980 | Hirata et al. | 83/62 |
| 4,255,998 | A | * | 3/1981 | Rudszinat | 83/298 |
| 4,430,914 | A | | 2/1984 | Keim | |
| 4,436,008 | A | | 3/1984 | Strunc | |
| 4,479,346 | A | * | 10/1984 | Chandler | 83/72 |
| 4,512,225 | A | * | 4/1985 | Green | 83/76 |
| 4,531,287 | A | | 7/1985 | Shibata et al. | |
| 4,604,632 | A | * | 8/1986 | Matsumoto | 101/93.07 |
| 4,981,059 | A | * | 1/1991 | Kobayashi | 400/621 |
| 5,000,069 | A | * | 3/1991 | Knobel | 83/285 |
| 5,042,340 | A | * | 8/1991 | Kasper | 83/367 |
| 5,315,398 | A | * | 5/1994 | Otsuki | 101/224 |
| 5,357,072 | A | * | 10/1994 | Garwick | 219/69.12 |
| 5,361,713 | A | * | 11/1994 | Suzuki | 83/74 |
| 5,363,709 | A | * | 11/1994 | Ives et al. | 83/522.23 |
| 5,871,429 | A | * | 2/1999 | Harding et al. | 493/25 |
| 5,875,698 | A | * | 3/1999 | Ceroll et al. | 144/286.5 |
| 5,894,416 | A | * | 4/1999 | Kuroyanagi et al. | 364/138 |
| 6,167,324 | A | * | 12/2000 | Gorman | 83/789 |
| 6,205,898 | B1 | * | 3/2001 | Surina | 83/76 |
| 6,698,323 | B2 | * | 3/2004 | Formon et al. | 83/62 |

* cited by examiner

*Primary Examiner*—Allan N. Shoap
*Assistant Examiner*—Jason Prone
(74) *Attorney, Agent, or Firm*—Winstead Sechrest & Minick P.C.

(57) ABSTRACT

A sheet cutting device utilizing cutter blades as a position detection mechanism and a method of reporting cutter malfunctions is provided. The sheet cutting device including a cutter having a pair of cutter blades, one of the blades connected to a cutter driving mechanism for moving the blade through a cutting cycle, a power source is connected to one of the blades so that a circuit is closed when the blades contact one another, and a current sensing device in connection with the circuit to identify when the blades are in physical contact.

12 Claims, 5 Drawing Sheets

CUTTER BLADE POSITION DETECTION MECHANISM AND METHOD OF REPORTING CUTTER MALFUNCTION

TECHNICAL FIELD

The present invention relates in general to utilizing cutter blades in a printer for identifying the position of the blades and for reporting cutter failures; and in particular, to utilizing cutter blades as an electrical switch to indicate when the cutting blades are in the fully open position and operating properly or malfunctioning and to a method of reporting the malfunction.

BACKGROUND INFORMATION

Many devices such as facsimiles and printers utilize continuous rolls of paper which require cutters. Some of these devices have a separate monitoring device to indicate when the blades are fully open and paper may be fed through the cutters. However, these cutter position devices do not indicate to an operator where in the cutting cycle the blades may not be closing or opening properly to allow an operator to accurately identify and correct malfunctions.

Various malfunctions may occur in the cutting process resulting in failure to cut, failure to completely cut material, and resulting in jamming of paper in the device. These failures can cause printer failure and loss of time and possibly sales for an operator of the printer. For example, it is very common to have point of sale (POS) printers for use with cash registers and check card/credit card printers. When the printer fails customers are forced to wait often resulting in loss of sales for the operator. Heretofore the printer operators only know when the cutters fail due to the fact that they have to manually cut the receipt from the paper roll, or there is a paper jam shutting down the printer. When there is a paper jam the operator may not realize that the jam is caused by the cutters failing to open completely, as opposed to a failure or malfunction in the printing system.

Several common types of cutter failures may appear random, but they indicate a problem which if addressed early will prevent any undue loss of time or operation of the printer. Other malfunctions may result in failure of the printer. If these symptoms of cutter blade wear, damage, or improper function of blades during the cutting process are noted and identified to the operator, the cutter may be disabled and service provided without excessive loss in time and operation of the printer.

It would be a benefit, therefore, to utilize the cutter blades as a switch to indicate when the cutter blades are fully open. It would be a further benefit to have a cutter blade position switch and a method which indicates when within a cutting cycle the cutter is malfunctioning. It would be a still further benefit to utilize the cutter blades to indicate when the cutter blades are malfunctioning and warn an operator or another of the malfunction.

SUMMARY OF THE INVENTION

It is thus an object of this invention to provide a cutter blade position switch utilizing the cutter blades to indicate when the blades are fully open.

It is a further object of this invention to provide a method of indicating when cutters are malfunctioning utilizing the cutter blades to indicate when fully open.

Accordingly, a sheet cutting device utilizing cutter blades as a position detection mechanism and a method of reporting cutter malfunctions is provided. The sheet cutting device includes a cutter having a pair of cutter blades, one of the blades connected to a cutter driving mechanism for moving the blade through a cutting cycle, a power source connected to one of the blades so that a circuit is closed when the blades contact one another, and a current sensing device in connection with the circuit to identify when the blades are in physical contact.

The cutter driving mechanism may include a pulse generator, a stepper motor drive, and a stepper motor. A pulse counter may be utilized to track the cutting cycle. By comparing the stage of the cutting cycle in which the blade switch opens and closes it can be determined if the cutter is performing properly.

The cutting device may include a processing unit for stopping and starting the cutter drive mechanism and monitoring the blade switch and counting the pulses to determine the position in the cutting cycle. By monitoring the switch positon and the pulse count compared to known data it can be determined if the cutter is working properly. If the cutter is not working properly the cutter motor drive may be stopped and an error message sent to a display unit. The processor may send a signal to restart the motor drive and attempt to correct the problem before sending an error message.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
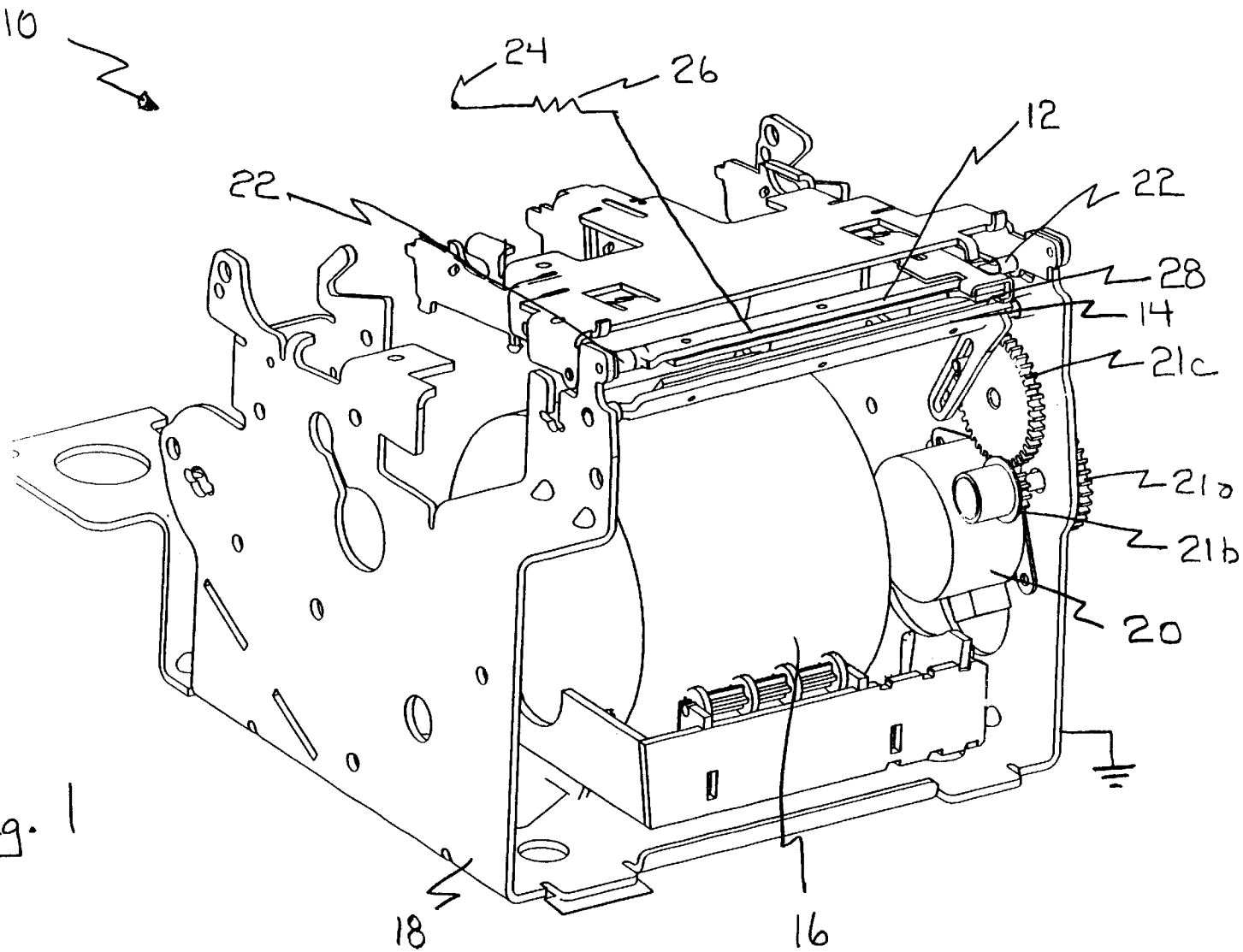
FIG. 1 is a perspective view of a continuous paper roll printing device, with the cover removed, utilizing the cutter blades as a cutter blade position detection switch.

Refer now to the drawings wherein depicted elements are not necessarily shown to scale and wherein like or similar elements are designated by the same reference numeral through the several views.

FIG. 1 is a perspective view of a continuous paper roll printing device 10, with the cover removed, utilizing cutter blades 12 and 14 as a cutter blade position detection switch. Printer 10 includes a continuous roll of paper 16, first blade 12, second blade 14, printer frame 18, and stepper motor 20.

As shown in FIG. 1, first blade 12 is a stationary blade and second blade 14 is a shear blade, each constructed of an electrically conductive material. In this embodiment, cutter blade 12 is connected to frame 18 with non-conductive bushings 22. Blade 14 is movably connected to frame 18 which is ground. A power source 24, such as but not limited to a DC source, is connected to first blade 12. A resistor 26 may be connected between power source 24 and blade 12. A non-conductive material 28 may be connected between a portion, or bonded to a portion of blade 12 or blade 14 to prevent conductive contact when the blades are not in a cutting position, but, the blades 12 and 14 are loaded against each other. When blades 12 and 14 are in the fully open position, as shown, there is no electrical contact between blade 12 and 14. When blades 12 and 14 contact during the cutting cycle a current will flow which can be detected.

Stepper motor 20 is operationally connected to blade 14 by gears 21*a*, 21*b*, and 21*c* to move blade 14 through a cutting cycle. When a cutting cycle is initiated, blades 12 and 14 contact one another along the conductive and cutting portion thereof, closing the circuit between power source 24 and frame ground 18 providing an indicating current.

Figure 2:
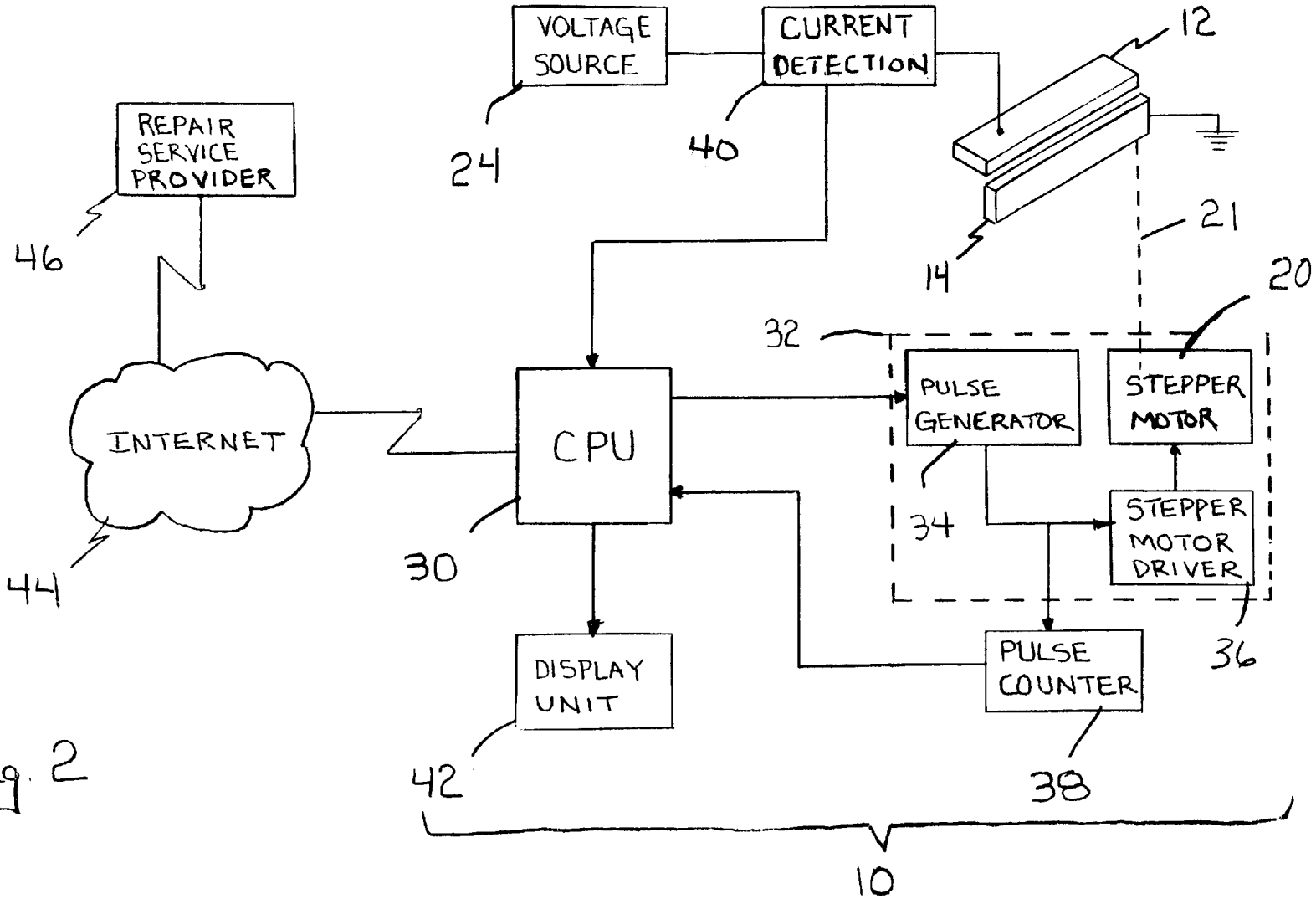
FIG. 2 is a block diagram showing electrical circuitry of a printing device of the present invention utilizing the cutter blades as a position detection mechanism.

FIG. 2 is a block diagram showing electrical circuitry of printing device 10 of the present invention utilizing cutter blades 12 and 14 as a position detection mechanism. As shown, cutting blades 12 and 14 are fully open to pass paper 16 (FIG. 1) therebetween. Paper 16 is fed through printer 10 and cutter blades 12, 14 by a motor (not shown) connected to CPU 30. CPU 30 includes a read only memory (ROM) storing programs for control by CPU 30 and stores constants, such as but not limited to pulse and time information for completing a cutting cycle, and current detection positions. CPU 30 may further include a random access memory (RAM) for storing variables and downloaded printing information and the like.

To initiate the cutting process a cutter driving mechanism 32 is activated by CPU 30. Cutter driving mechanism 32 includes a stepper motor pulse generator 34, a stepper motor driver 36, and stepper motor 20. Stepper motor 20 is mechanically connected 21 to blade 14 to move blade 14 in incremental steps through the cutting cycle. For each step, stepper motor pulse generator 34 generates an electrical step pulse signal. Stepper motor driver 36 receives the electrical step pulse signals from pulse generator 34 and activates stepper motor 20. A pulse or step counter 38 receives the electrical step pulse signals from stepper motor pulse generator 34. Step counter 38 counts these step pulse signals as part of the cutting cycle and in combination with signals from blades 12 and 14 it can be determined precisely when blades 12, 14 are fully opened or closed. Pulse counter 38 may be reset to zero after each cutting cycle.

When the cutting cycle begins, blades 12 and 14 should contact one another along a conductive portion closing the circuit between voltage source 24 and blade 14 which is connected to frame 18 ground (FIG. 1), thus performing as an electric switch. A current detection device 40 may be connected to the line between voltage source 24 and blades 12, 14 and to CPU 30 or a direct connection to CPU 30 for receiving a signal when blade switch 12, 14 is closed or opened, may be used.

CPU 30 may be connected to a display unit 42 for displaying operating information such as cutter malfunction determined from the opening and closing of blades 12, 14 in relation to the timing of the occurrence within the cutting cycle. Display unit 42 includes a LED (light-emitting device), a LCD (liquid crystal display) or the like, and displays information such as that there is incomplete cutting, blade lock, or that blades 12, 14 are not fully open. Error codes and or recommendations such as "call a service representative," "disconnect cutters," may be displayed.

CPU 30 may also be connected to a network 44 such as the Internet, in a manner well known in the art, which connects to the repair service provider 46. In this manner, an error message may be sent to service provider 46 for prompt response.

Figure 3:
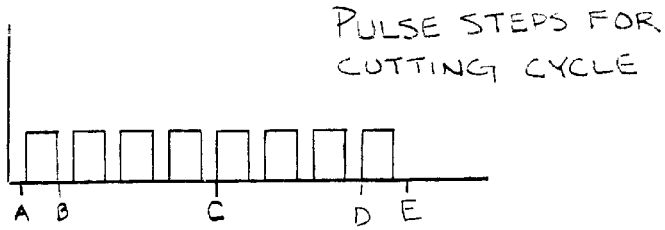
FIG. 3 is a representative plot of motor pulse steps during a full cutting cycle.

With reference to FIGS. 1 through 9, FIGS. 3 through 8 are representative plots of pulse step counts and current detection indicating when blades 12, 14 are fully open or in contact with one another. FIG. 3 is a representative plot of pulse signals sent to stepper motor 20 to move blade 14 through a complete cutting cycle. Point "A" represents the approximate point at which the signal is sent and blade 14 begins to move. Point "B" is the approximate point at which blades 12, 14 should be in contact and the circuit across blades 12, 14 is closed. Point "C" is the approximate point at which cutter blades 12, 14 begin to move apart. Point "D" is the approximate point at which blades 12, 14 are approaching fully open. Point "E" is the point at which blades 12, 14 should be in the fully open position, and thus the circuit is open. As shown in FIGS. 3 through 8, points "A" through "E" are approximate points, however, the number of pulses and the incremental movement of blade 14 for each step may be accurately calculated through the cutting cycle.

Figure 4:
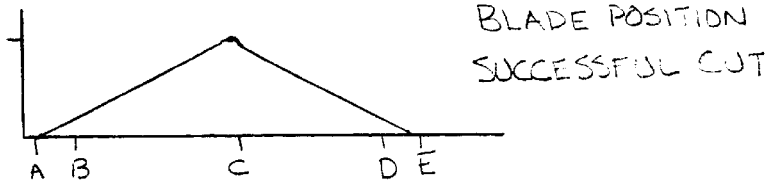
FIG. 4 is a representative plot of the physical position of the cutter blades as they proceed through a full cutting cycle resulting in a successful cut of paper.
Figure 5:
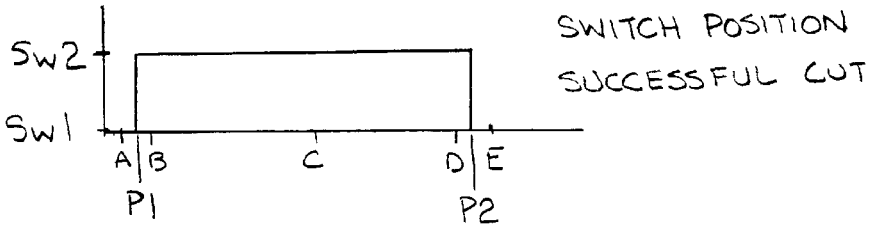
FIG. 5 is a representative plot of the switch signal formed by the blades opening and closing in a complete, successful cut of paper.

FIG. 4 is a representative plot of the physical position of cutter blades 12, 14 as they go through a full cutting cycle in a successful cut of the paper. FIG. 5 is a representative plot of the switch signal formed by blades 12 and 14 opening and closing. The switch being open (Sw1) when blades 12 and 14 are not in electrical contact and the switch being closed (Sw2) when blades 12 and 14 are in electrical contact. FIG. 5 represents a complete and successful cut wherein blades 12, 14 contact between points "A" and "B", designated by P1, closing the circuit, and wherein blades physically open between points "D" and "E", designated by P2, opening the circuit.

The closing and opening of the switch in relation to the pulse position at the time of switch operation can be utilized to properly diagnose a problem and predict and prevent failures. One malfunction, "cutter drive failure", which is not shown graphically is if the switch fails to close P1 between points "A" and "B". This malfunction can be immediately addressed by disabling the cutter drive and manually tearing the paper until the problem can repaired.

Figure 6:
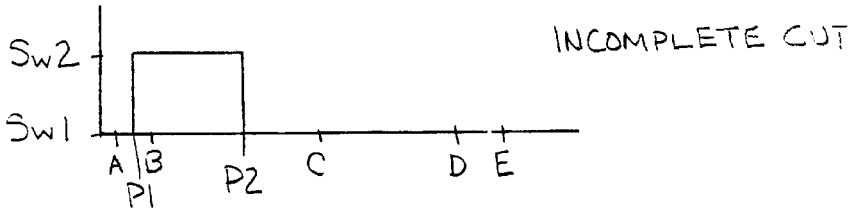
FIG. 6 is a representative plot of the opening Sw1 and the closing Sw2 of the switch at a position indicative of an incomplete cut of paper.

FIG. 6 is a representative plot of the opening Sw1 and the closing Sw2 of the switch in a position indicative of in an incomplete cut. In an incomplete cut, the switch opens Sw1 at P2 which is before point "C", indicating that blades 12 and 14 are no longer in contact before reaching point "C." This is indicative of worn blades 12, 14 which may be replaced before the problem worsens.

Figure 7:
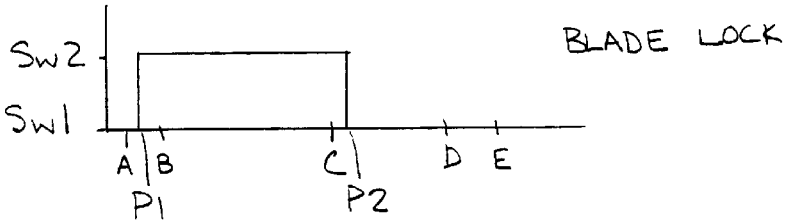
FIG. 7 is a representative plot of the opening Sw1 and the closing Sw2 of the switch at a position indicative of blade lock.

FIG. 7 is a representative plot of the opening Sw1 and the closing Sw2 of the switch at a position indicative of blade lock. As shown, blades 12, 14 contact and the switch closes Sw2 at P1 between points "A" and "B" which is proper operation. However, the switch opens Sw1 at P2 which is after point "C" but before point "D." This is commonly caused by a burr or wear point on blades 12, 14 that causes the blades to hang on each other and open too soon in the cutter open sequence resulting in an incomplete cut.

Figure 8:
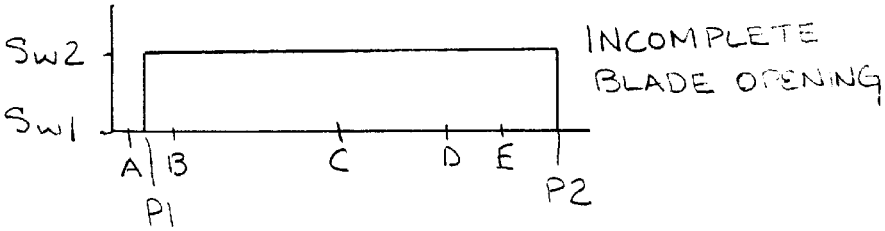
FIG. 8 is a representative plot of the opening Sw1 and the closing Sw2 of the switch at a position indicative of incomplete blade opening.

FIG. 8 is a representative plot of the opening Sw1 and the closing Sw2 of the switch at a position indicative of incomplete blade opening. Incomplete blade opening results when blades 12, 14 remain in contact after the cutting cycle is completed and is indicated by the switch remaining closed Sw2 or opening Sw1 after point "E." This malfunction can be catastrophic in that it can cause a paper jam. When this malfunction is detected, the printer logic 30 may disable the cutter and instruct the operator to manually open the cutter and to use the tear bar. A service call to the repair service provider should be made.

Figure 9:
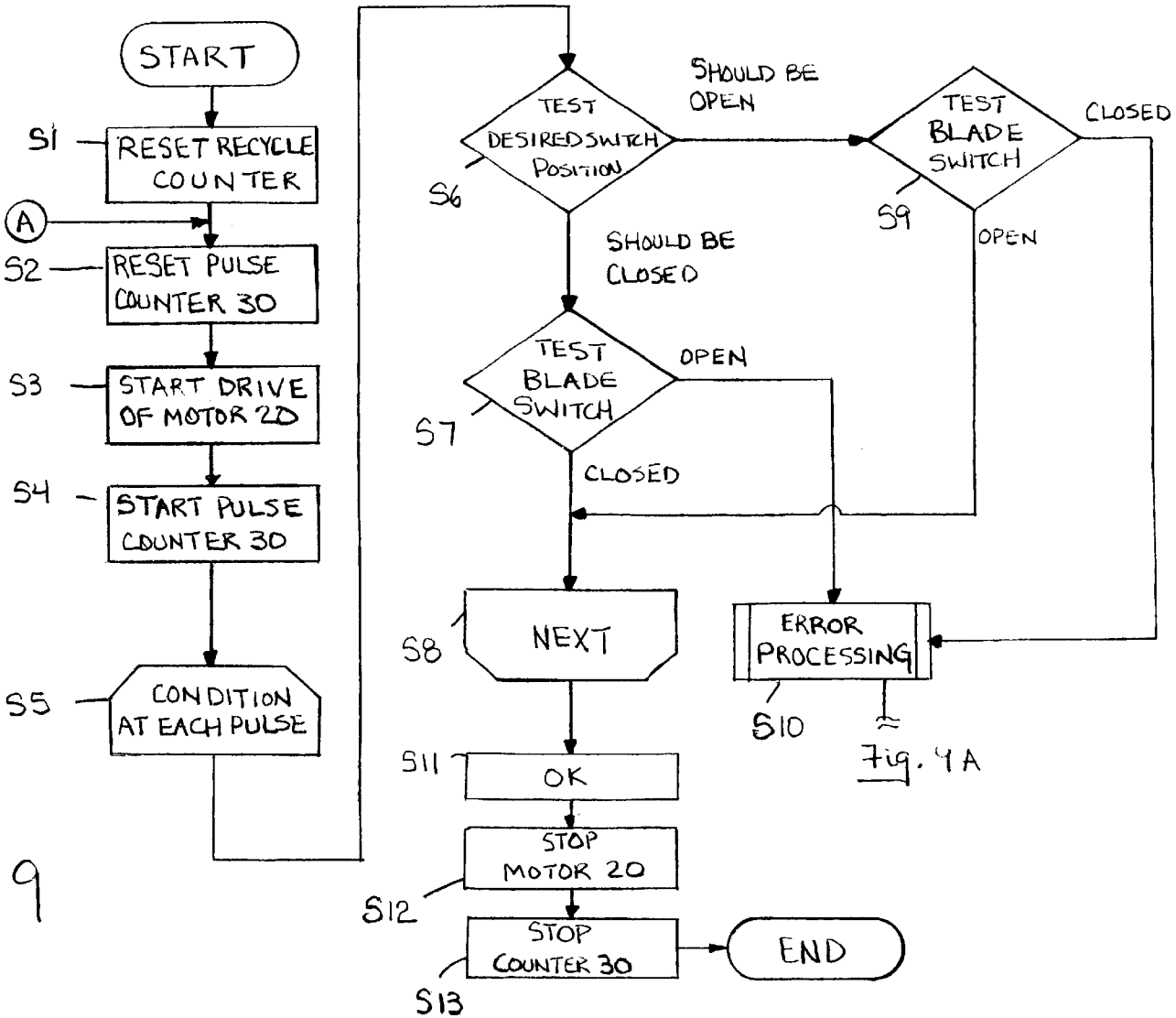
FIG. 9 including 9A is a flowchart of the invention as shown in FIGS. 1 through 8.
Figure 9A:
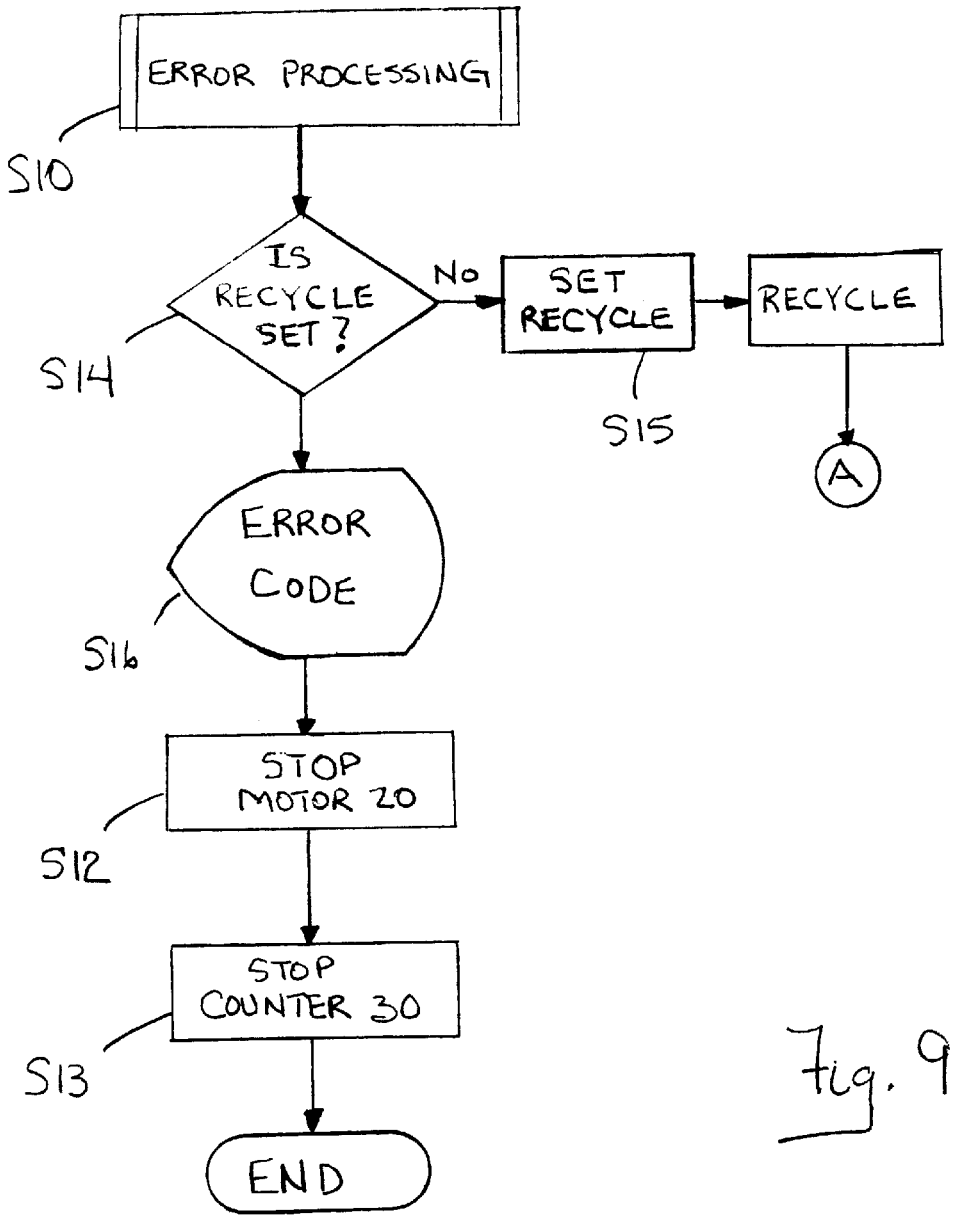

FIGS. 9 and 9A are flowcharts of the system of FIGS. 1 through 8. When the paper driving motor (not shown) is stopped the cutting cycle is started. A recycle counter step S1 may be set for a predetermined number of times that the system will try to correct an error. In step S2 pulse counter 30 is reset to zero. Simultaneously, stepper motor 20 is engaged in step S3 and pulse counter 30 is started in step S4. Each pulse is tested in step S5, to determine if the switch formed by blades 12, 14 is in the proper position, either open or closed, as predetermined for each pulse. In step S6, the test for each pulse begins, for example at point "A" shown in FIGS. 1 through 8, the switch should be open, in step 9 the switch would be tested and if the switch is open the process would continue for the next pulse, if the switch is closed, CPU 30 in steps S10 through S16 determines whether to attempt to open and close blades 12, 14 and begin the cycle at step S2 or to display an error S16 and stop motor 20, step S12, and counter 30, step S13. In step S6, if the switch is supposed to be closed at that particular pulse, for example at point "C" shown in FIGS. 1 through 8, the circuit is tested in step S7, if the circuit is open, CPU 30 in steps S10 through S16 determines whether to begin the cutter cycle again or display an error S16 and stop motor 20, step S112, and counter 30, step S113, if the circuit is closed.

Although the present invention and its advantages have been described in detail, it should be understood that various changes, substitutions and alterations, such as but not limited to, changing which blade is hot and which is grounded, can be made herein without departing from the spirit and scope of the invention as defined by the appended claims.

What is claimed is:

1. A sheet cutting device comprising:

a cutter having a first and a second blade;

a cutter driving mechanism in connection with at least one of said blades for moving said blade through a plurality of positions for cutting material;

a voltage source in connection with said first blade; and a current sensing device connected between said voltage source and said cutter for detecting an electrical current when said blades are in contact with one another.

2. The cutting device of claim 1, further including:

a processing unit in functional connection with said cutter driving mechanism and said current detection mechanism;

wherein said processing unit starts and stops said cutter driving mechanism and records whether said blades are in contact via said current detection.

3. The cutting device of claim 2, further including:

a display unit in connection with said processing unit for receiving a signal from said processing unit and displaying a condition of said blades.

4. The cutting device of claim 1, further including:

a counter in connection with said cutter driver mechanism for determining said plurality of positions.

5. The cutting device of claim 4, further including:

a processing unit in functional connection with said cutter driving mechanism, said current detection mechanism, and said counter;

wherein said processing unit starts and stops said cutter driving mechanism and records whether said blades are in contact via said current detection, and records positions in the cutting cycle.

6. The cutting device of claim 5, further including:

a display unit in connection with said processing unit for receiving a signal from said processing unit and displaying a condition of said blades.

7. A sheet cutting device comprising:

a cutter having a first and a second blade, said first blade insulated from electrical ground, said second blade electrically grounded;

a cutter driving mechanism in connection with at least one of said blades for moving said blade through a plurality of positions for cutting a sheet of material;

a voltage source in connection with said first blade;

a current sensing device connected between said voltage source and said cutter for detecting an electrical current when said blades are in contact with one another;

a counter in connection with said cutter driving mechanism for determining said plurality of positions within a cutting cycle;

a display unit; and a processing unit in connection with said current sensing device, said cutter driving mechanism, said counter, and said display unit;

wherein said processing unit starts and stops said cutter driving mechanism and monitors said current sensing device and said counter for displaying a condition of said cutter.

8. The printer of claim 7, wherein:

said processing unit is connected to a remote repair service provider via a network.

9. A printer comprising:

a frame carrying paper for printing;

a cutter connected to said frame, said cutter having a first and a second blade, said first blade insulated from electrical ground, said second blade electrically grounded;

a cutter driving mechanism in connection with at least on of said blades for moving said blade through a plurality of positions for cutting said paper;

a voltage source in connection with said first blade;

a current sensing device connected between said voltage source and said cutter for detecting an electrical current when said blades are in contact with one another;

a counter in connection with said cutter driving mechanism for determining said plurality of positions within a cutting cycle;

a display unit; and a processing unit in connection with said current sensing device, said cutter driving mechanism, said counter, and said display unit;

wherein said processing unit starts and stops said cutter driving mechanism and monitors said current sensing device and said counter for displaying a condition of said cutter.

10. The printer of claim 9, wherein:

said paper is a continuous roll of paper.

11. The printer of claim 9, wherein:

said printer is connected to a remote repair service provider via a network.

12. The printer of claim 11, wherein:

said paper is a continuous roll of paper.

* * * * *